US010724285B2

(12) United States Patent
Dodge et al.

(10) Patent No.: US 10,724,285 B2
(45) Date of Patent: Jul. 28, 2020

(54) DAMPENING TRANSLATOR FOR SLIDING BUILDING CLOSURE

(71) Applicant: Milgard Manufacturing Incorporated, Tacoma, WA (US)

(72) Inventors: Travis James Dodge, Tacoma, WA (US); Michael Barton, Orting, WA (US); Eric Baczuk, Puyallup, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 279 days.

(21) Appl. No.: 15/181,492

(22) Filed: Jun. 14, 2016

(65) Prior Publication Data

US 2016/0369548 A1 Dec. 22, 2016

Related U.S. Application Data

(60) Provisional application No. 62/182,032, filed on Jun. 19, 2015.

(51) Int. Cl.

| | |
|---|---|
| ***E05F 5/00*** | (2017.01) |
| ***E05F 5/02*** | (2006.01) |
| ***E05F 3/22*** | (2006.01) |
| ***E05F 1/16*** | (2006.01) |

(52) U.S. Cl.

CPC ..... *E05F 5/003* (2013.01); *E05F 1/16* (2013.01); *E05F 3/224* (2013.01); *E05F 5/027* (2013.01); *E05Y 2900/132* (2013.01)

(58) Field of Classification Search

CPC ..... E05F 5/003; E05F 5/027; E05F 1/16

See application file for complete search history.

(56) References Cited

U.S. PATENT DOCUMENTS

| | | | | |
|---|---|---|---|---|
| 2,992,450 | A * | 7/1961 | Pittenger | E05F 1/16 16/198 |
| 5,513,469 | A * | 5/1996 | Tajudeen | E05F 1/16 49/404 |
| 8,186,489 | B2 | 5/2012 | Zimmer et al. | |
| 8,443,551 | B2 | 5/2013 | Walhorn | |
| 9,388,622 | B1 * | 7/2016 | Paron | E05F 15/56 |
| 9,879,459 | B2 * | 1/2018 | Zimmer | E05F 3/10 |
| 2014/0033475 | A1 * | 2/2014 | Saito | E05F 1/16 16/49 |
| 2014/0109343 | A1 * | 4/2014 | Chang | E05F 5/003 16/49 |

(Continued)

FOREIGN PATENT DOCUMENTS

| | | | |
|---|---|---|---|
| DE | 102009053436 A1 * | 5/2011 | E05F 5/003 |
| WO | WO 2016/180783 * | 11/2016 | |

*Primary Examiner* — Gregory J Strimbu

(74) *Attorney, Agent, or Firm* — Reising Ethington P.C.

(57) ABSTRACT

A dampening translator for a sliding building closure comprising a housing having a longitudinal axis and a traveler track with a longitudinally extending portion having a first end. A traveler is carried by the housing and includes a body carrying track followers carried in the traveler track of the housing, and carrying longitudinally spaced walls extending away from the body and establishing a catch space therebetween. A retractor is carried by the housing and has a housing portion coupled to the housing and a traveler portion coupled to the traveler to bias the traveler in a direction toward the first end of the traveler track. A dampener is carried by the housing to decelerate the traveler.

23 Claims, 3 Drawing Sheets

(56) References Cited

U.S. PATENT DOCUMENTS

| | | | | |
|---|---|---|---|---|
| 2015/0047150 | A1* | 2/2015 | Saito | E05F 5/02 16/103 |
| 2015/0204129 | A1* | 7/2015 | Park | E05F 5/003 16/51 |
| 2017/0051548 | A1* | 2/2017 | Wang | E05F 5/02 |
| 2017/0130501 | A1* | 5/2017 | Svara | E05F 3/00 |

* cited by examiner

DAMPENING TRANSLATOR FOR SLIDING BUILDING CLOSURE

TECHNICAL FIELD

This disclosure relates generally to building closures and, more particularly, to openers and closers for sliding closures.

BACKGROUND

Conventional sliding closures for buildings, for example, sliding glass doors, typically include frames and sliding panels slidably carried in the frames. Some conventional closures also may be equipped with electro-mechanical closers that may be bulky, complex, and/or costly.

DETAILED DESCRIPTION

In general, a dampening translator for a sliding building closure will be described using one or more examples of illustrative embodiments of a sliding door that includes a door frame, a sliding door panel slidably carried by the frame, and the translator coupled between the door frame and the door panel. The example embodiments will be described with reference to a closer, its use with a sliding glass door, and with reference to the door being translated toward its closed position. But it will be appreciated as the description proceeds that the dampening translator may be implemented in many other embodiments including sliding windows, sliding screen doors, and other slidable building closures. Likewise, the dampening translator may be useful in many different applications including use as a door opener as the door is being translated toward its open position. In this case, the dampening translator may resist slamming of the door against a frame when the door is being opened. Accordingly, the translator may be a closer and/or an opener.

Figure 1:
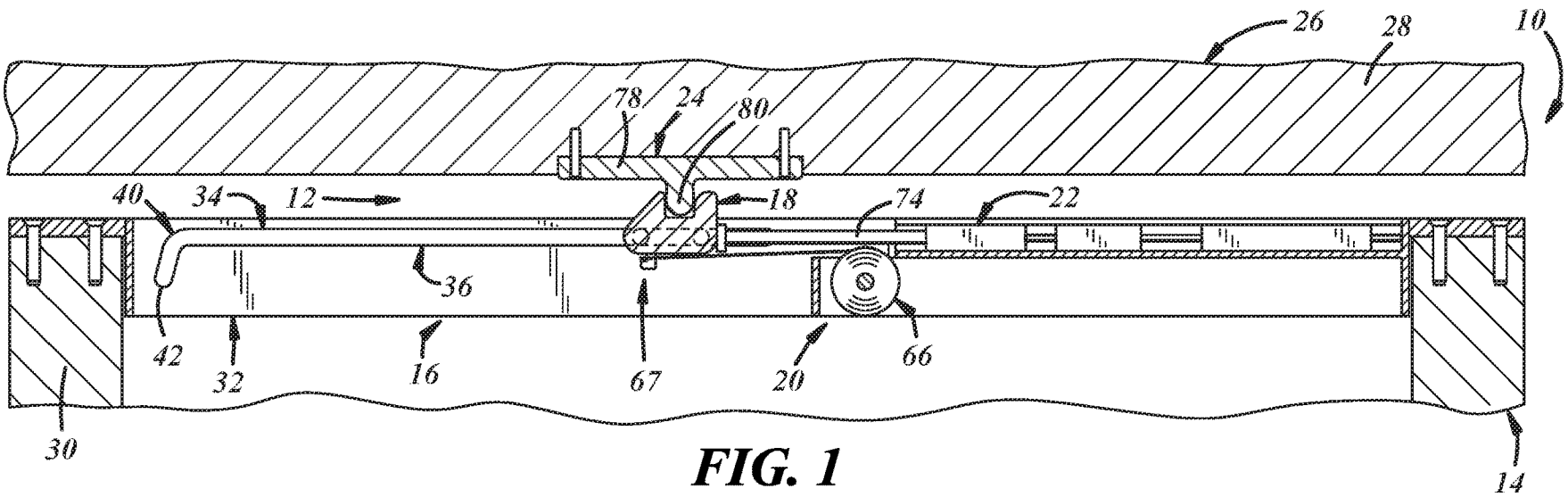
FIG. 1 is a schematic, fragmentary, cross-sectional, side view according to an illustrative embodiment of an assembly including a dampening translator carried in a head of a slidable closure that is slidably carried in a frame, and including a housing, a traveler translatably carried by the housing, a retractor carried by the housing, a dampener carried by the housing, and a catch carried by a frame header to engage the traveler.

Referring specifically to the drawings, FIG. 1 shows an assembly 10 that includes an illustrative embodiment of a dampening translator 12 for a slidable building closure 14. The dampening translator 12 may be used to apply a bias force to the building closure 14 during an end portion of closing travel, or opening travel, of the closure when the closure 14 is closed, or opened. Also, the dampening translator 12 may be used to decelerate or dampen the opening or closing of the closure 14 against the bias force. In any case, the translator 12 may assist with closing and/or opening a building closure 14.

With reference to FIG. 1, the translator 12 may include a housing 16, a traveler 18 translatably carried by the housing 16, a retractor 20 carried by the housing 16 to apply a bias force to the traveler 18 to retract the traveler 18, a dampener 22 carried by the housing 16 to decelerate the traveler 18 against the bias force applied thereto by the retractor 20, and a catch 24 to engage the traveler 18. Also, the assembly 10 may include a frame 26 including a header 28 (frame jambs and sill not shown). The closure 14 may include a sliding door 30 slidably carried in the frame 26 and including a head 32 (door jambs and sill not shown). In the illustrated embodiment, the frame header 28 may carry the catch 24, and the sliding door head 32 may carry the rest of the translator 12. In another embodiment, the sliding door head 32 may carry the catch 24, and the frame header 28 may carry the rest of the translator 12. As will be described in greater detail below, the translator 12 includes novel components and novel arrangements of components that may solve one or more problems with conventional sliding door translators.

Figure 2:
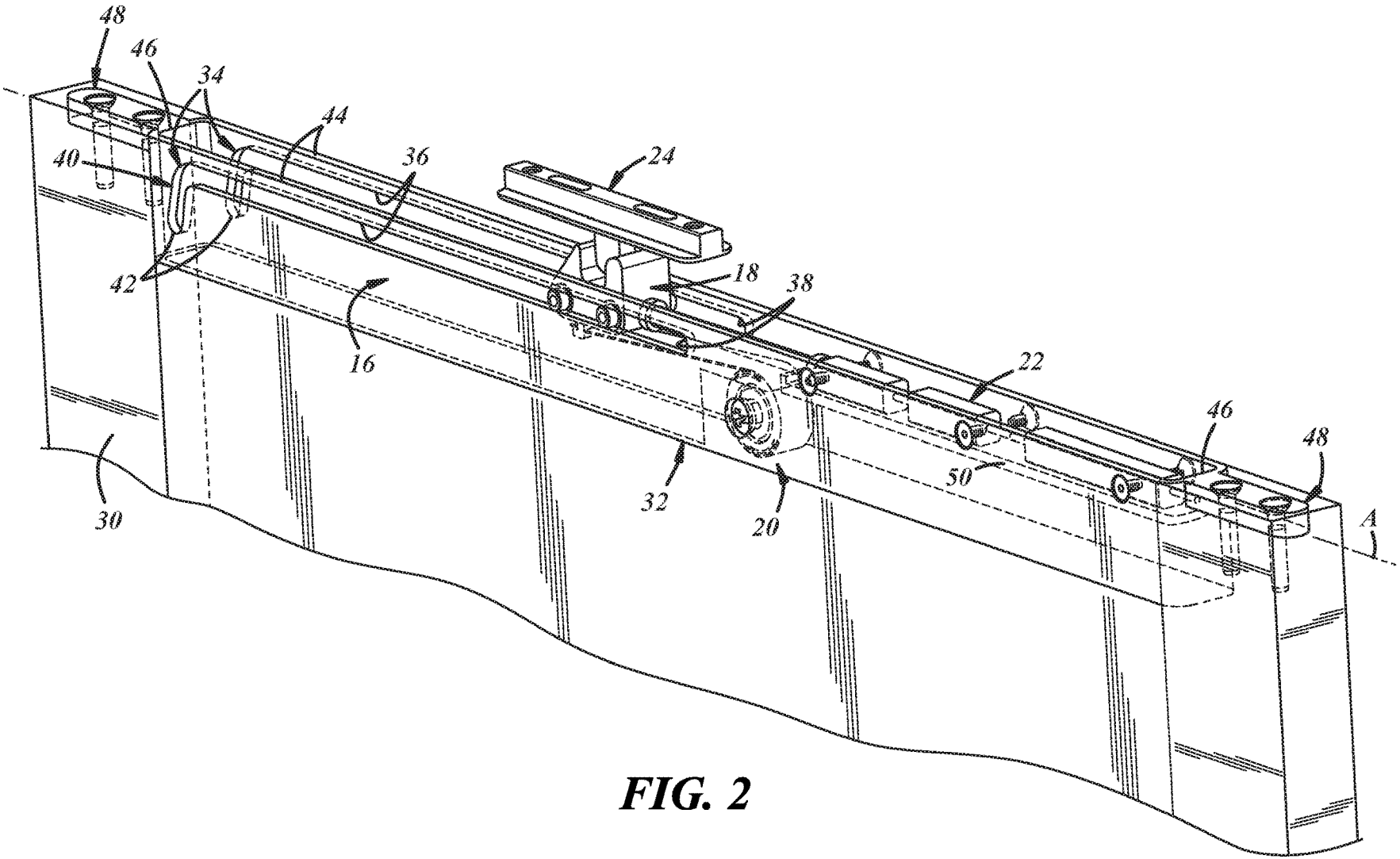
FIG. 2 is a fragmentary perspective view of the assembly of FIG. 1.

With reference to FIG. 2, the housing 16 extends along a longitudinal axis A and includes a traveler track 34 that may include a longitudinally extending portion 36 having a first end 38 and an angled portion 40 extending at an obtuse angle with respect to the longitudinally extending portion 36 and having a second end 42. In the illustrated embodiment, the housing 16 includes laterally spaced side walls 44 having slots establishing the traveler track 34. The traveler 18, the retractor 20, and the dampener 22 may be carried between the housing side walls 44. Also, the housing 16 may include longitudinally spaced end walls 46 having mounting flanges 48 extending longitudinally outwardly therefrom. Further, the housing 16 may include a dampener platform 50 extending laterally between the side walls 44 to support the dampener 22 thereon. In the illustrated embodiment, the housing 16 includes a component separate from and carried by the door 30. In other embodiments, the housing 16 or portions thereof may be completely or partially integrated into the door 30. In other words, the housing 16 and the head 32 may be the same in the illustrated embodiment, but in other embodiments, the housing 16 may be carried in or by a head of a closure.

Figures 3, 4:
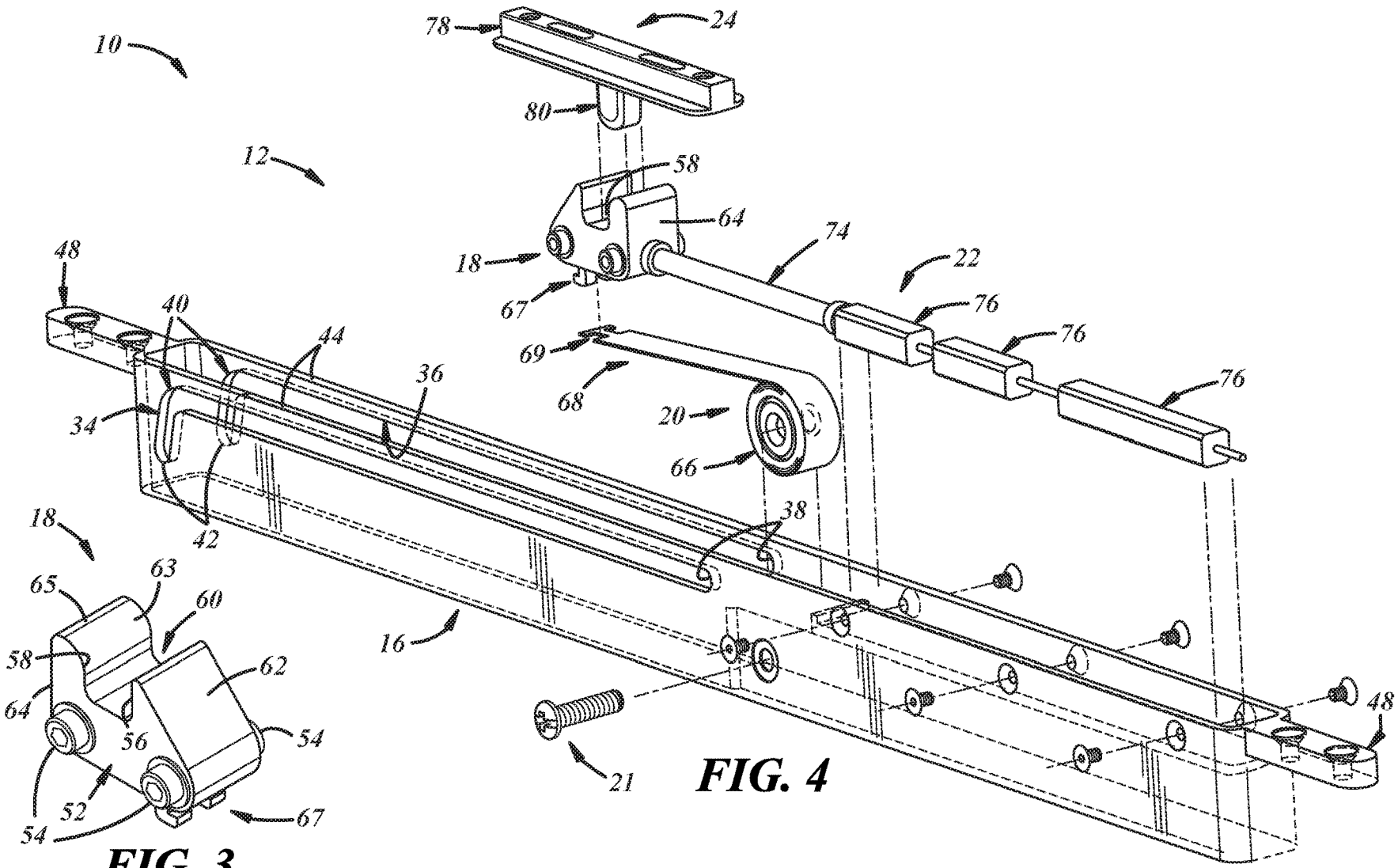
FIG. 3 is an enlarged perspective view of the traveler of FIG. 1.
FIG. 4 is an exploded perspective view of the assembly of FIG. 1.

The traveler 18 is carried by the housing 16 of the translator 12. Referring now to FIG. 3, the traveler 18 includes a body 52 carrying track followers 54 configured to be carried in the traveler track 34 (FIG. 2) of the housing 16 (FIG. 2), and longitudinally spaced walls 56, 58 extending away from the body 52 and establishing a catch space 60 therebetween. The walls include an upstream wall 56 and a downstream wall 58. The upstream wall 56 is the wall on the right in FIG. 3 and the downstream wall 58 is the wall on the left in FIG. 3. The upstream traveler wall 56 may have an upstream surface 62, which may be flat and may be disposed at an angle to the longitudinal axis, for example, between 65 and 85 degrees, including all ranges and subranges therebetween. The downstream traveler wall 58 includes a downstream surface 64 that may be flat and perpendicular to the longitudinal axis to facilitate engagement with the dampener 22 (FIG. 1), and an upstream surface 63 that is rounded and that smoothly blends into a free end surface 65 of the wall 58 to engage the catch 24 (FIG. 1). Also, the traveler 18 may include the track followers 54, for instance, four or more track followers. The track followers 54 may include roller elements, bearings, or the like, rotatably coupled to the traveler body 52, or wear shoes or the like fixed to the traveler body 52, or any other suitable track followers.

Referring now to FIG. 4, the retractor 20 may be carried by the housing 16 and has a housing portion 66 to be coupled to the housing 16 and a traveler portion 68 to be coupled to the traveler 18 to bias the traveler 18 in a direction toward the first end 38 of the traveler track 34. The housing portion 66 may be rotatably coupled to the housing 16 by being mounted on a fastener 21, for instance, the illustrated screw or bolt. In FIG. 4, the traveler portion 68 is illustrated as being decoupled from the traveler 18. But the dashed lines indicate one possible embodiment of how the traveler portion 68 may be coupled to the traveler 18, for instance, via interengagement of a T-shaped end 69 of the traveler portion 68 and corresponding laterally spaced legs 67 of the traveler 18. Those of ordinary skill in the art will recognize that the traveler portion 68 may be coupled via interengaging features as illustrated, or via fasteners, welding, or any other suitable coupling arrangement.

The retractor 20 may include a spring. In one embodiment, the spring may include, for instance, a constant force spring. The housing portion 66 may include a rolled or coiled portion rotatably coupled to the housing 16, and the traveler portion 68 may include the end 69 coupled to the traveler 18. In another embodiment, the retractor 20 may include a coiled tension spring that may be anchored at one end to the housing 16, wound around a roller (not shown) rotatably coupled to the housing 16, and coupled at another end to the traveler 18. In other embodiments, the retractor 20 may include a compression spring disposed between the housing 16 and the traveler 18 at the upstream wall 62 of the traveler 18, or any other type of retractor in any other location suitable to bias the traveler 18 in a direction away from the end 42 of the angled portion 40 of the traveler track 34 and toward the opposite end 38 of the longitudinal portion 36 of the traveler track 34.

With continued reference to FIG. 4, the dampener 22 is carried by the housing 16 to decelerate the translator 12 against the bias force applied thereto by the retractor 20. The dampener 22 may decelerate the translator 12 over an end portion of closing travel or opening travel of the closure 14 when the closure 14 is closed or opened. For example, the end portion may encompass the last 10% to 50% of longitudinal travel of the translator 12, including all ranges and sub-ranges therebetween. The dampener 22 may include an armature 74 longitudinally overlapping a portion of the traveler track 34. In the illustrated embodiment, the dampener 22 includes one or more gas springs 76, and the armature 74 may include a piston, piston rod, or piston attachment extending longitudinally and adapted for engagement with the traveler 18. In other embodiments, the dampener 22 may include one or more viscous dampeners, elastomeric dampeners, or any other suitable dampeners, and the armature 74 may include a rod, extension, or any other element suitable to engage the traveler 18 to the dampener 22.

Figure 5:
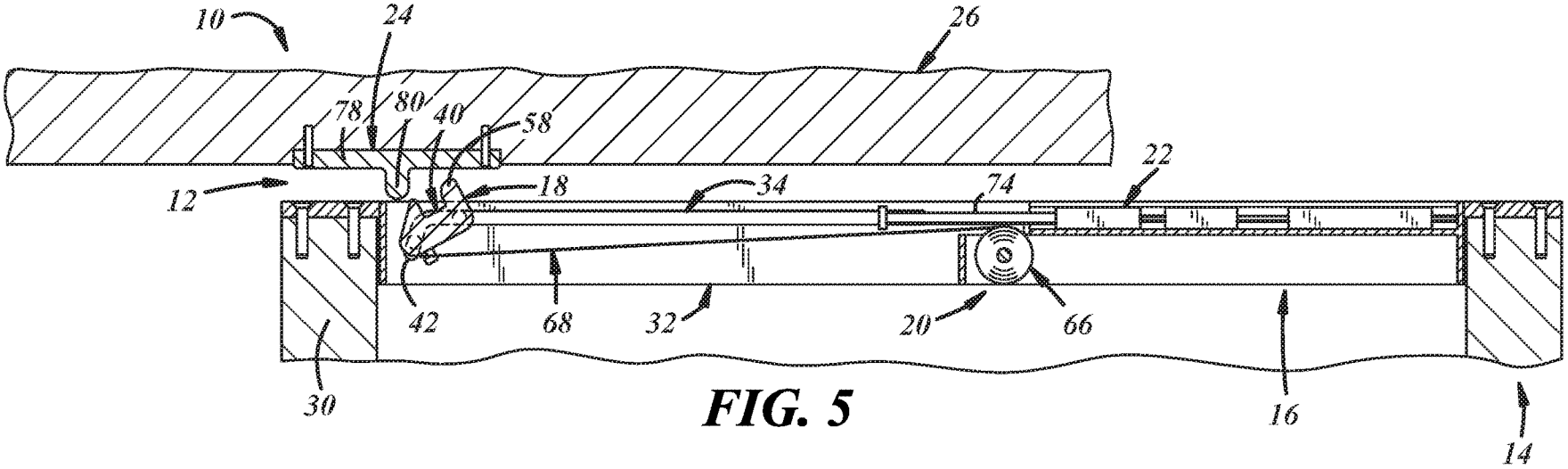
FIG. 5 is a fragmentary, cross-sectional, side view of the assembly of FIG. 1.

With reference to FIG. 5, the catch 24 may be mounted to the frame 26 and may include a base portion 78 and a tooth portion 80 extending away from the base portion 78. In other embodiments, the catch 24 may be an integral portion of the frame 26. In any case, the tooth portion 80 of the catch 24 may be engageable with the downstream traveler wall 58 when the traveler 18 is located in the angled portion 40 of the traveler track 34 and against the second end 42 thereof, for instance, when the door 30 is being translated toward its closed position.

With reference to FIG. 2, when the door 30 is in a closed or nearly closed position, the traveler 18 may be located at the first end 38 of the traveler track 34, or at least proximate the first end 38 of the traveler track 34. In any case, when the door 30 is moved from its closed position toward an open position, for example, to a fully opened position, the door 30 will translate relative to the catch 24 and the traveler 18 until the traveler 18 falls into the angled portion 40 of the traveler track 34, and thereby releases from the catch 24, as shown in FIG. 5. Those of ordinary skill in the art will recognize that the location, configuration, and dimensions of the angled portion 40 of the track 34, of the traveler 18, and of the retractor 20 allow the traveler 18 to remain in the angled portion 40 at the second end 42 of the traveler track 34 even though the retractor 20 applies a bias force to the traveler 18. When the door 30 is moved from its open position toward the closed position, eventually the catch 24 will engage the downstream wall 58 of the traveler 18, thereby urging the traveler 18 out of the angled portion 40 of the traveler track 34, wherein the retractor 20 may assist with closing the door 30, as shown in FIGS. 1 and 2. The retractor 20 may translate the door 30 such that the door 30 moves relative to the catch 24 and the traveler 18 and, eventually, the traveler 18 will engage the armature 74 of the dampener 22, whereafter the dampener 22 decelerates the traveler 18 so as to decelerate the closing of the door 30.

In general, the components of the translator can be manufactured according to techniques known to those skilled in the art, including molding, machining, stamping, and the like. Also, the translator can be assembled according to known techniques, including manual and/or automatic assembly. Likewise, any suitable materials can be used in making the components, for example, metals, composites, polymeric materials, and the like.

The present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Moreover, features of various implementing embodiments may be combined to form further embodiments of the invention. Therefore, the claimed invention is not limited to the particular examples of illustrative embodiments disclosed herein.

The invention claimed is:

1. A dampening translator for a sliding building closure, comprising:

a housing having a longitudinal axis and laterally spaced side walls and including a traveler track with a longitudinally extending portion having a first end, wherein the housing traveler track also includes an obtusely angled portion extending at an obtuse angle with respect to the longitudinally extending portion and having a second end, wherein the traveler track portions intersect at a juncture and wherein the longitudinally extending portion extends along the longitudinal axis from the first end to the juncture and the obtusely angled portion extends along a second axis from the second end to the juncture;

a traveler translatably carried by the housing and including a body carrying track followers carried in the traveler track of the housing and carrying longitudinally spaced walls extending away from the body and establishing a catch space therebetween;

a retractor carried by the housing and having a housing portion coupled to the housing and a traveler portion coupled to the traveler to bias the traveler in a direction toward the first end of the traveler track; and a dampener carried by the housing to decelerate the traveler and including an armature, wherein, when in operation, a free end of the armature is spaced apart from the traveler when the traveler is located proximate the second end of the traveler track, wherein the retractor is configured to translate the sliding building closure and the traveler such that the sliding building closure and the traveler move and, eventually, the traveler engages the free end of the armature, whereafter the dampener decelerates the traveler along 10% to 50% of a longitudinal travel of the traveler travels between the juncture and the first end of the traveler track, wherein the retractor comprises a constant force spring, wherein the housing portion includes a coil portion of the constant force spring rotatably mounted on a threaded fastener extending through one of the laterally spaced side walls to the other one of the laterally spaced side walls of the housing.

2. The translator of claim 1, wherein the laterally spaced side walls have slots establishing the traveler track, and the traveler, the retractor, and the dampener are disposed between the laterally spaced side walls of the housing.

3. The translator of claim 1, wherein the housing also includes end walls having mounting flanges extending outwardly therefrom.

4. The translator of claim 1, wherein the housing includes a dampener platform extending laterally between the spaced side walls to support the dampener thereon.

5. The translator of claim 1, wherein the track followers comprise at least four track followers.

6. The translator of claim 1, wherein the coil portion of the spring is coupled to the housing at a position that overlaps the armature of the dampener.

7. The translator of claim 1, wherein the track followers are roller elements rotatably coupled to the traveler body.

8. The translator of claim 1, wherein one of the traveler walls includes a upstream surface that is rounded and that blends into a free end surface of the one of the traveler walls.

9. The translator of claim 1, wherein one of the longitudinally spaced walls of the traveler includes a wall having a downstream surface that is flat.

10. The translator of claim 9, wherein the flat is perpendicular to the longitudinal axis.

11. The translator of claim 1, wherein the armature overlaps a portion of the traveler track.

12. The translator of claim 1, wherein the laterally spaced side walls of the housing have upper ends, the housing also includes end walls having upper ends and having outwardly extending mounting flanges coplanar with the upper ends of the side walls and the end walls.

13. The translator of claim 1, further comprising:

a catch for mounting to a frame of a door assembly and including a base portion and a tooth portion extending away from the base portion.

14. The translator of claim 13, wherein the tooth portion of the catch is engageable with one of the traveler walls when the traveler is located in the angled portion of the traveler track and is against the second end of the traveler track.

15. The translator of claim 1, wherein the dampener includes at least one gas spring.

16. A translator for a sliding building closure, comprising:

a housing having a longitudinal axis, laterally spaced side walls and longitudinally spaced end walls, laterally spaced side walls having slots establishing a traveler track having a longitudinally extending portion having a first end and an angled portion having a second end;

a traveler translatably carried by the housing and including a body carrying track followers carried in the traveler track of the housing and carrying longitudinally spaced walls extending away from the body and establishing a catch space therebetween;

a retractor carried by the housing and comprising a constant force spring having a housing portion coupled to the housing and a traveler portion coupled to the traveler to bias the traveler in a direction toward the first end of the traveler track, wherein the housing portion includes a coil portion of the constant force spring rotatably mounted on a threaded fastener extending through one of the laterally spaced side walls to the other one of the laterally spaced side walls of the housing; and a dampener carried by the housing to decelerate the traveler and including an armature, wherein, when in operation, a free end of the armature is spaced apart from the traveler when the traveler is located proximate the second end of the traveler track, wherein the retractor is configured to translate the sliding building closure and the traveler such that the sliding building closure and the traveler move and, eventually, the traveler engages the free end of the armature, whereafter the dampener decelerates the traveler along 10% to 50% of a longitudinal distance the traveler travels along the longitudinally extending portion of the traveler track.

17. A sliding door, comprising:

a door panel frame of the sliding building closure of claim 1 including a head; and the translator of claim 1 carried by the head of the door panel frame.

18. A sliding door assembly, comprising:

a frame including a header carrying a catch including a base portion and a tooth portion extending away from the base portion; and the sliding door of claim 17 slidably carried in the frame, wherein the tooth portion of the catch is engageable with the traveler.

19. A dampening translator, comprising:

a housing having a longitudinal axis and including laterally spaced side walls having slots establishing a traveler track, the traveler track having a longitudinally extending portion having a first end and a second portion having a second end;

a traveler translatably carried by the housing and including a body carrying track followers carried in the traveler track of the housing;

a retractor carried by the housing and having a housing portion coupled to the housing and a traveler portion coupled to the traveler to bias the traveler in a direction toward the first end of the traveler track; and a dampener carried by the housing to decelerate the traveler and including an armature, wherein, when in operation, a free end of the armature is spaced apart from the traveler when the traveler is located proximate the second end of the traveler track, wherein the retractor is configured to translate a sliding building closure and the traveler such that the sliding building closure and the traveler move and, eventually, the traveler engages the free end of the armature, whereafter the dampener decelerates the traveler along 10% to 50% of a longitudinal distance the traveler travels along the longitudinally extending portion of the traveler track, wherein the retractor comprises a constant force spring carried between the laterally spaced side walls of the housing, wherein the housing portion includes a coil portion of the constant force spring rotatably mounted on a threaded fastener extending through one of the laterally spaced side walls to the other one of the laterally spaced side walls of the housing.

20. The translator of claim 19, wherein the retractor is coupled to one end of the traveler.

21. The translator of claim 19, wherein the traveler body is unitary and wherein the dampener directly engages the unitary traveler body.

22. The translator of claim 19, wherein the translator assists with opening the sliding building closure.

23. The translator of claim 19, wherein the translator assists with closing the sliding building closure.

* * * * *